US006459214B1

(12) United States Patent
Chen et al.

(10) Patent No.: US 6,459,214 B1
(45) Date of Patent: Oct. 1, 2002

(54) HIGH FREQUENCY/HIGH POWER FACTOR INVERTER CIRCUIT WITH COMBINATION CATHODE HEATING

(75) Inventors: Timothy Chen, Germantown, TN (US); Melvin C. Cosby, Lakewood; James K. Skully, Willoughby, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,451

(22) Filed: Apr. 10, 2001

(51) Int. Cl.[7] ..... H05B 37/02
(52) U.S. Cl. ..... 315/247; 315/209 R; 315/291
(58) Field of Search ..... 315/247, 209 R, 315/291, DIG. 7, 308, DIG. 4, 224, 324, 307, 219, 248, DIG. 2

(56) References Cited

U.S. PATENT DOCUMENTS 5,416,387 A * 5/1995 Cuk et al. ..... 315/209 R
5,680,015 A * 10/1997 Bernitz et al. ..... 315/291
5,936,357 A * 8/1999 Crouse et al. ..... 315/247
5,969,483 A * 10/1999 Li et al. ..... 315/224
6,137,239 A * 10/2000 Wu et al. ..... 315/291
6,169,374 B1 * 1/2001 Chang ..... 315/224
6,281,636 B1 * 8/2001 Okutsu et al. ..... 315/209 R
6,337,800 B1 * 1/2002 Chang ..... 315/209 R

* cited by examiner

*Primary Examiner*—Don Wong
*Assistant Examiner*—Chuc Tran
(74) *Attorney, Agent, or Firm*—Fay, Sharpe, Fagan, Minnich & McKee, LLP

(57) ABSTRACT

Prior to a load being activated, a first capacitive network and the load are operationally in parallel with each other, and the first capacitive network and a first inductor are in series with each other. A second inductor is magnetically coupled to the first inductor to boost a voltage supplied to the load. When the load is activated, a second capacitive network, the load, and the first inductor are operationally in series with each other. In a further embodiment, the first inductor and a second inductor are not capacitively coupled together, rather the second inductor generates lagging current at a first node to cancel leading current generated by the first capacitive network. Heating of the load is accomplished by the use of a cathode heater winding in operational connection with at least one of the cathodes.

14 Claims, 3 Drawing Sheets

HIGH FREQUENCY/HIGH POWER FACTOR INVERTER CIRCUIT WITH COMBINATION CATHODE HEATING

BACKGROUND OF INVENTION

The present invention is directed to electronic ballasts, and more particularly to an inverter circuit topology which has improved operational efficiencies over existing electronic ballasts.

FIG. 1 illustrates a conventional parallel load, series resonant electronic ballast 10. Electronic ballast 10 is supplied by an a.c. input source 12. An input signal from input source 12 is rectified by full-bridge rectifier circuit 14 consisting of diodes 16–22. The signal generated by full bridge rectifier circuit 14 is supplied, through an input filter 24, to switching network 26, consisting of switches 28 and 30. Switches 28 and 30 are connected together at one end via node 37 , and may be controlled by a known controller 32, such as a complementary switching system or other known design. Output from switching network 26 is supplied through inductor 34 to a lamp starting circuit 36. Lamp starting circuit 36 includes d.c. blocking capacitor arrangement 38 with capacitors 40 and 42, resonant capacitors 44 and 46and a positive temperature co-efficient element 48 such as a thermister. D.C. blocking capacitors 40, 42 are connected to each other at node 43. Lamp 50 is connected to ballast 10 via cathodes 52 and 54. Capacitor 55 is used as an energy storage capacitor. D.C. blocking capacitor arrangement 38 and capacitor 55 are connected at a first end to circuit bus 56 and at a second end to reference bus 57. Upon initiation of operation a signal from switching network 26 causes energization of the lamp starting circuit 36, wherein cathodes 52 and 54 are heated prior to the igniting of lamp 50. Additional circuit connections are well known in the art, and are not shown for purposes of clarity for the present description.

Ballast 10 may be considered a parallel load, series resonant circuit in that lamp 50 is placed in parallel with resonant capacitors 44 and 46 which are in series with resonant inductor 34. Positive temperature coefficient element 48 is provided parallel to resonant capacitor 44 to preheat the cathodes. Ballast 10 is useful for operation in single lamp that has low lamp arc current. It provides sufficient voltage for starting of lamp 50, and also works efficiently during the running of lamp 50 following the breakdown of gases in the discharge lamp.

A drawback to the described conventional parallel load, series resonant ballast and other similar ballasts is that high current stresses which exist on the resonant components and switching devices for high bus voltage implementations. High bus voltage, for example, in Europe is approximately 325 volts, and in the U.S. it is in the range of 390 volts for 277 RMS voltage input.

High currents are problematic since the resulting high lamp arc current not only goes through the switching devices but also goes through, for example, the resonant inductor 34. Therefore, resonant inductor 34 sees a summation of current which includes the lamp arc current and the resonant capacitor current through capacitors 44 and 46. The lamp arc current may vary, depending upon what type lamps are used. For example, for a 28-watt compact fluorescent lamp (CFL) T-4, the lamp arc current may be 210 milli-amps, while for a T-6 2D lamp, the lamp current may be 360 milli-amps or higher. This means the resonant inductor needs to be of a significant size to avoid becoming saturated and to ensure that the power dissipation is not excessive. It is also necessary to use switches such as Field Effect Transistors (FETs), Bipolar Junction Transistors (BJTs) or other known switching devices having high current ratings.

Another drawback of ballast 10 is that it's resonant circuit has a poor power factor, where the input tank current and voltage are significantly out of phase, especially for the lamp with high lamp's arc current. An issue is that the signal delivered by switching network 26 from node 37 has its current and voltage out of phase, wherein the current through inductor 34 is out-of-phase with the voltage from node 37 to 43. This out-of-phase state means more current to the tank than necessary to drive the lamp. For example, if only 30 watts were necessary in a fully in-phase system, in an out-of-phase system it may be necessary to deliver 50 or 60 watts of apparent power from the output of switches 28 and 30. The excess apparent power circulates between resonant circuit 36 and switch network 26 resulting in the dissipation of a large amount of power in the components.

In these high voltage implementations it is necessary to use components sized to handle the noted stresses and excess current. However, these larger than desired components are more expensive than smaller components, and take up more physical space. Since the electronics industry is increasingly striving to decrease the cost and size of the ballasts, the foregoing noted inefficiencies are impediments to the objectives of the industry. This is especially true for ballasts used to power lamps such as integral compact fluorescent lamps, high intensity discharge lamps and others.

Therefore, it is considered desirable to configure an inverter circuit topology which improves the power factor of the ballast's tank circuit, to reduce the current stress on the resonant components and switching devices, allowing the use of smaller sized components. It is also desirable to provide a circuit which improves the output regulation over lamp impedance variations due to thermal effects, to provide a flexibility in preheating of the circuit, and for an overall improved and more economical ballast.

SUMMARY OF INVENTION

A high frequency, high power factor inverter circuit is provided to generate current for a load. A first inductor is connected to receive an input voltage. A second inductor is connected at one end to the load and at a second end to a first node. The second inductor is further magnetically coupled to the first inductor in a configuration which increases or boosts the voltage to the lamp. A first capacitive network is connected in parallel across the load. A second capacitive network is connected in series with the load, wherein the second capacitive network has a capacitive value larger than the first capacitive network. Prior to the load being activated, the first capacitive network and the load are operationally in parallel with each other, and the first capacitive network and first inductor are in series with each other. When the load is activated, the second capacitive network, the load, and the first inductor are operationally in series with each other. In a further embodiment, the first inductor and second inductor are not coupled together, rather the second inductor generates lagging current at a first node which acts to cancel leading current generated by the first capacitive network at the first node. The summation current at the first node may be less than the current otherwise seen by the system. Heating of the load, when it is a gas discharge lamp having cathodes is accomplished by the use of a cathode heater winding in operational connection with at least one of the cathodes and magnetically coupled to the first inductor.

DETAILED DESCRIPTION

Figure 1:
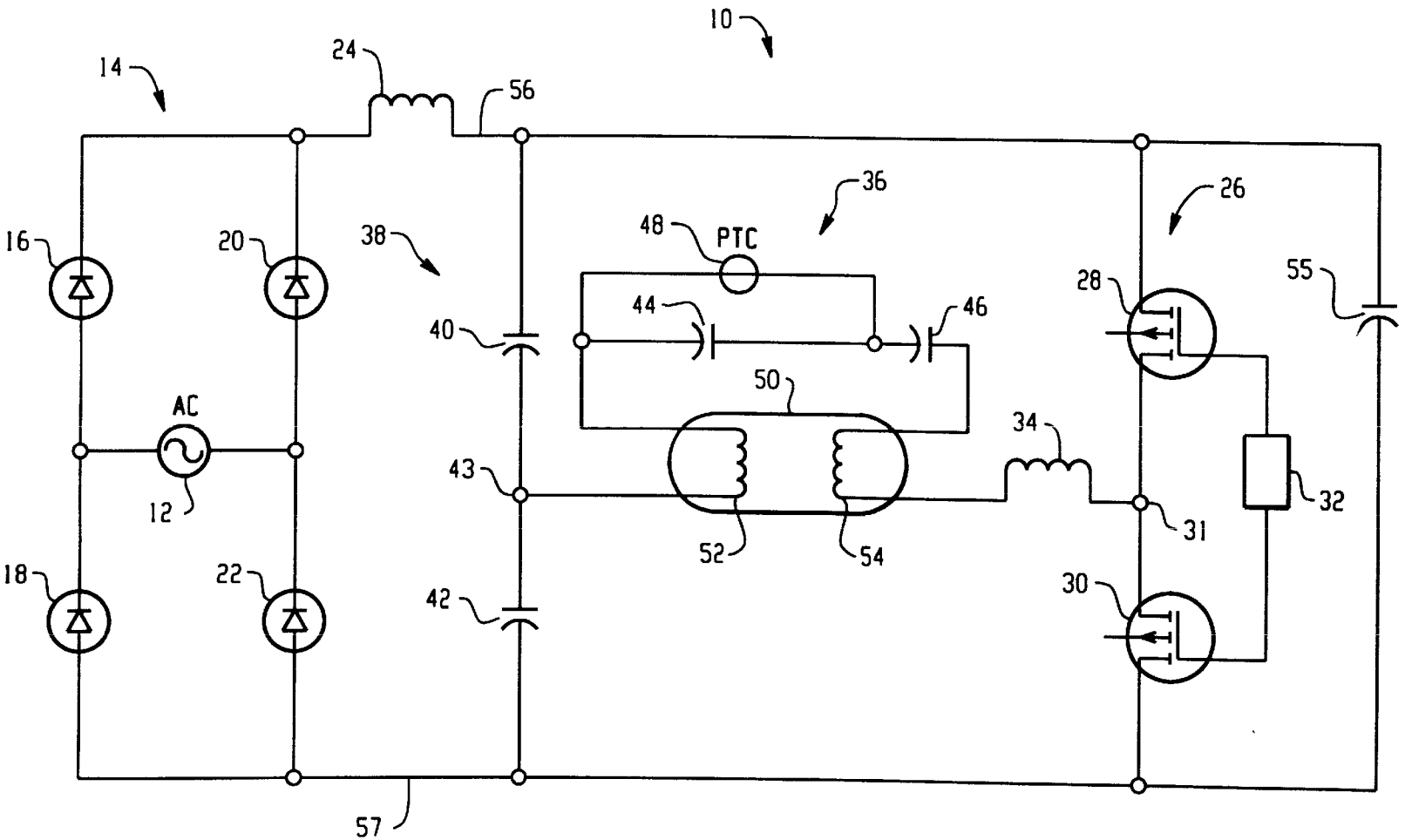
Fig. 1 Prior Art
FIG. 1 illustrates a conventional series resonant parallel load electronic ballast.

In addition to a first inductor 34, also provided is a second inductor 62 and an external cathode beater winding 64. First inductor 34 and second inductor 62 being connected at a first node 76. Each of inductors 34, 62 and heater winding 64 are shown to be magnetically coupled. Inductors 34 and 62 are coupled in a phase relationship such as to act as an auto-transformer providing a voltage step-up of the input signal This step up or boost function is useful in permitting the ballast to be used with a variety of lamps. For example, where a CFL lamp is known as an easy starting lamp since it can be started at relatively lower voltages, an HID lamp, or other high-pressure discharge lamp is difficult to start, requiring higher starting voltages. Using the step-up transformer configuration formed by inductors 34 and 62 allows for the increase of voltage necessary for sing high voltage lamps. Cathode heater winding 64, coupled to inductors 34 and 62, provides a manner of supplying voltage in order to heat cathode 54.

Figure 2:
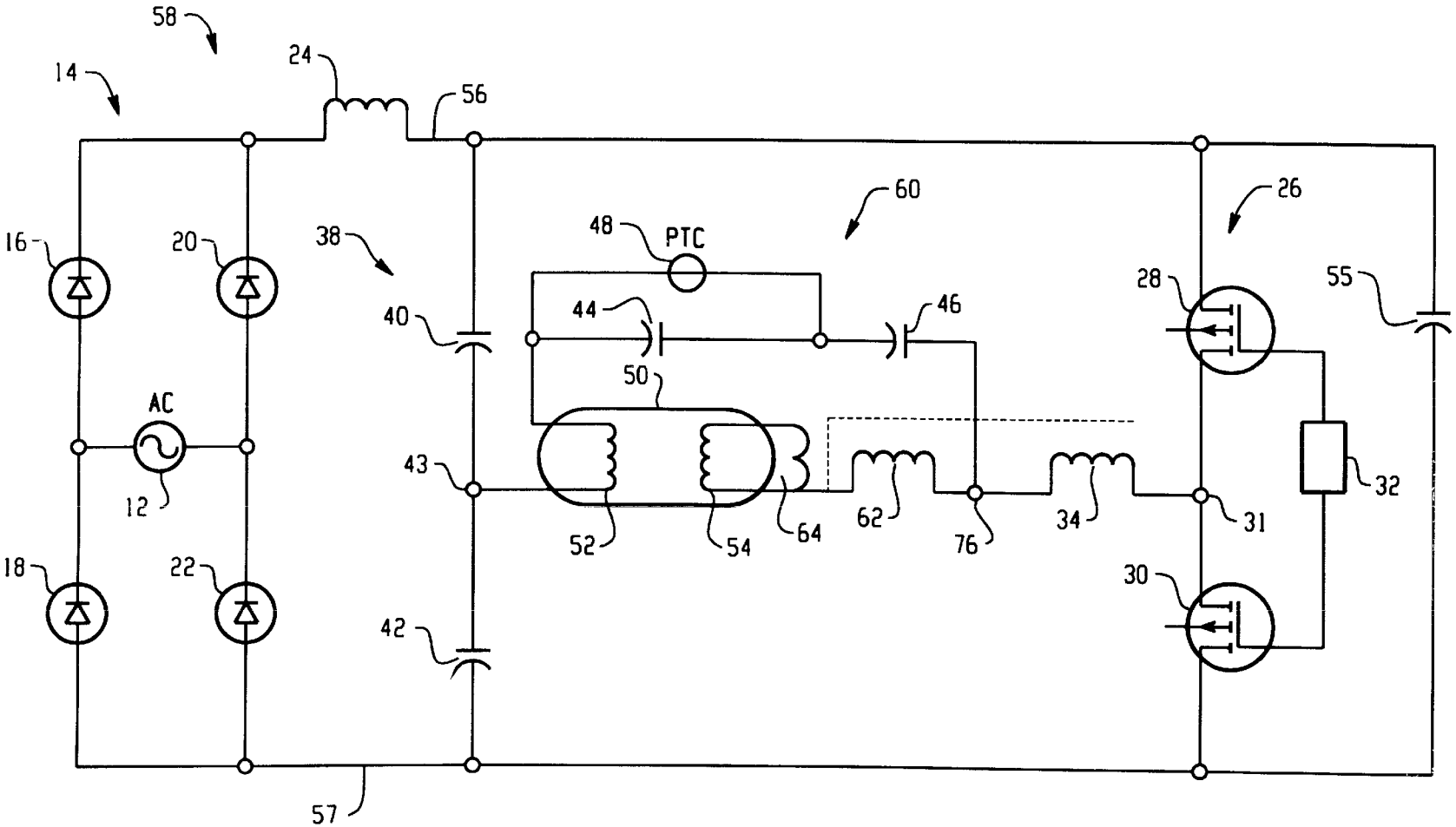
FIG. 2 depicts a first embodiment of an improved electronic ballast for use in higher lamp current implementations.

The configuration of circuit 58 of FIG. 2 provides a new topology wherein prior to operation of lamp 50, during the heating stage, the circuit functions in a manner different from that during its running-time operation stage. Prior to the breakdown of the lamp, i.e. during the heating stage, a resonant circuit is formed by inductor 34, and the combination of a first capacitive network of resonant capacitors 44 and 46. However, in this embodiment, unlike that of FIG. 11 a second capacitive network or combination 40 and 42 does not function only as a d.c. blocking capacitor configuration. Rather, following the breakdown of the lamp, during the operation of lamp 50, they become part of the resonant circuit 60, as their values are lowered to affect the resonant circuit. Although the combination of capacitors 40 and 42 are at a lower value than the same numbered capacitors in FIG. 1, they are nevertheless much larger than capacitors 44 and 46.

In addition to inductor 34, also provided is a second inductor 62 and an external cathode heater winding 64. Each of inductors 34, 62 and heater winding 64 are shown to be magnetically coupled. Inductors 34 and 62 are coupled in a phase relationship such as to act as an auto-transformer providing a voltage step-up of the input signal. This step-up or boost function is useful in permitting the ballast to be used with a variety of lamps. For example, where a CFL lamp is known as an easy starting lamp since it can be started at relatively lower voltages, an HID lamp, or other high-pressure discharge lamp is difficult to start, requiring higher starting voltages. Using the step-up transformer configuration formed by inductors 34 and 62 allows for the increase of voltage necessary for starting high voltage lamps. Cathode heater winding 64, coupled to inductors 34 and 62, provides a manner of supplying voltage in order to heat cathode 54.

The configuration of circuit 58 of FIG. 2 provides a new topology wherein prior to operation of lamp 50, during the heating stage, the circuit functions in a manner different from that during its running-time operation stage. Prior to the breakdown of the lamp, i.e. during the heating stage, a resonant circuit is formed by inductor 34, and the combination of resonant capacitors 44 and 46. However, in this embodiment, unlike that of FIG. 1 , the capacitor combination 40 and 42 does not function only as a d.c. blocking capacitor configuration. Rather, following the breakdown of the lamp, during the operation of lamp 50, they become part of the resonant circuit 60, as their values are lowered to affect the resonant circuit. Although the combination of capacitors 40 and 42 are at a lower value than the same numbered capacitors in FIG. 1 , they are nevertheless much larger than capacitors 44 and 46.

Prior to breakdown and starting of lamp 50, ballast 58 is a parallel load, series resonant circuit, somewhat similar to that of FIG. 1 . However, when the lamp is in the running or operational state, the functioning of the components changes and capacitors 40 and 42 function as part of the resonant circuit.

Once the lamp ignites, operation of ballast 58 changes, and it begins loading up, due to the size selected for capacitors 44 and 46. Now the circuit resonance is dominated by the resonance between capacitors 40 and 42 and inductors 34 and 62. The combination of capacitors 40and 42 allows for its equivalent circuit to be put in parallel whereby the combination of capacitors 40, 42, lamp 50 and inductors 34, 62 are in series. Therefore, the resonant circuit is now converting to a series load, series resonant circuit . This is distinct from operation during the heating pre-lamp operation time, where the circuit is more of a parallel load, series resonant. At that time lamp 50 is in parallel with capacitors 44 and 46as no current is flowing. However, once the lamp ignites, circuit operation is altered. This is true because capacitors 44 and 46 are small enough that their operation as parallel capacitors to load 50 is diminished whereby the larger capacitor combination 40 and 42 is configured to act as if it is in series with lamp 50 and inductor 34.

Circuit 72 is similar to previously described circuit 60 including a parallel load portion and a series circuit portion formed by the first capacitive network of resonant capacitors 44 and 46. However, in this embodiment, a second inductor 74 is not magnetically coupled to a first inductor 75. This is different from FIG. 2 where second inductor 62 is coupled magnetically to first inductor 34 to form a type of voltage boost auto-transformer.

Figure 3:
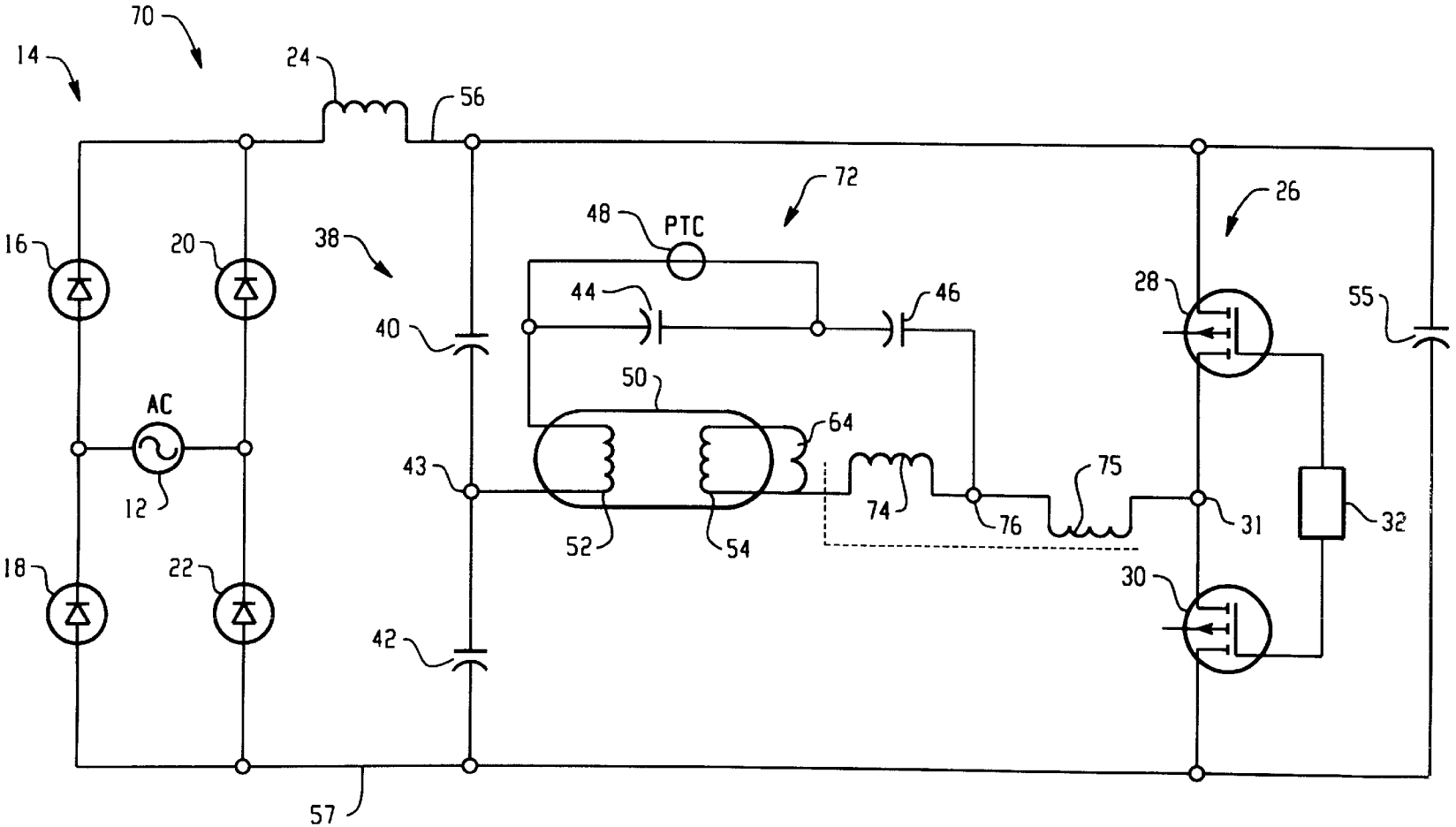
FIG. 3 depicts a second embodiment of an electronic ballast for use in high frequency/high lamp current situations.

Turning to FIG. 3, ballast 70 is a further embodiment of the present invention. In circuit 70, capacitors 40 and 42 function as d.c.-blocking components and are not used as part of the resonant circuit, as used in the configuration of FIG. 2.

Circuit 72 is similar to previously described circuit 60, including a parallel load portion and a series circuit portion formed by resonant capacitors 44 and 46. However, in this embodiment, an inductor 74 is not magnetically coupled to inductor 75. This is different from FIG. 2where inductor 62 is coupled magnetically to inductor 34 to form a type of voltage boost auto-transformer.

Once lamp 50 ignites, it is placed in series with inductor 74. This results in a lagging current at node 76. The current through the path including resonant capacitors 44 and 46 on the other hand, results in a leading current at node 76. Summation of the leading and lagging currents, result in at least a partial cancellation of these currents thereby providing for an improved unified signal and an improved power factor. This allows for the use of smaller sized magnetics or inductors 74 and 75. For example, inductor 74 may only need to be sized to handle the lamp current. Further, inductor 75 may be smaller than inductor 34 used in the circuit of FIG. 1 . Particularly, while inductor 34 of FIG. 1 must be sized to handle both the lamp current and any capacitive current, inductor 75 may be sized smaller due to the cancellation of current occurring at node 76. Due to the cancellation of current at node 76, the possibility exists for inductor 75 to see current even lower than lamp current.

Inductor 75 and external cathode heater winding 64 are magnetically coupled. This provides the source for energization of the cathode for a preheat operation to assist in lamp starting.

In FIG. 1 the preheating of the cathodes is accomplished by use of the current going through capacitors 44 and 46, and therefore both sides of lamp 50 are heated by the same source. However, due to the implementation of the embodiment shown in FIGS. 2 and 3, it is not possible to access cathode 54 in the same manner. Therefore, winding 64 is magnetically coupled to at least one of the inductors in order to supply voltage to cathode 54. It is to be appreciated that either or both of the cathodes may be coupled in this manner.

The heating of cathodes 52 and 54 are shown in the manner described when the present invention is implemented using fluorescent lamps. However, for other lamps, such as HID lamps, heater winding 64 would not be needed since only a single electrode post is implemented in the HID lamps. Component values for the circuits of FIGS. 3 described in the foregoing, would include:

| | |
|---|---|
| Diode Bridge 14 | 1N4005 |
| Filter Inductor 24 | 680 uh |
| Switches 28, 30 | IRFR320&LQD4P40 |
| Inductor 34 | 1.85 mh |
| Capacitors 40 | 0.22 uf |
| Capacitors 42 | 0.22 uf |
| Capacitor 44 | 10 nf |
| Capacitor 46 | 0.068 nf |
| Lamp 50 | F38W2D |
| Inductor 74 | 680 uh |
| Inductor 75 | 1.85 mh |

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A high frequency, high power factor inverter circuit for generating a current for a load, the inverter circuit comprising:

A first inductor connected to receive an input voltage;

a second inductor connected at one end to the load, and at a second end to a first node, the second inductor further being connected to the first inductor to act in combination as a voltage step-up auto-transformer which increases the input voltage;

a first capacitive network connected in parallel across the load and the second inductor;

a second capacitive network connected in series with the load, the second capacitive network having a capacitive value larger than the first capacitive network, wherein prior to the load being activated the first capacitive network and the load are operationally in parallel with each other, and the first capacitive network and the first inductor are in series with each other and, when the load is activated the second capacitive network, the load, and the first inductor are operationally in series with each other.

2. The inverter circuit according to claim 1 further including a cathode heater winding magnetically coupled to the first and second inductors.

3. The inverter circuit according to claim 2 wherein the load is a lamp having a first cathode and a second cathode, the first cathode connected at a first end to the first capacitive network and at a second end to the second capacitive network, and the second cathode in operational connection with the cathode heater winding.

4. The inverter circuit according to claim 1 wherein prior to the load being activated, a resonant load circuit including the first capacitive network and the first inductor exists.

5. The inverter circuit according to claim 1 wherein after the load is activated, a resonant load circuit including the second capacitive network and the first inductor exists.

6. The inverter circuit according to claim 1 wherein the load is a gas discharge lamp.

7. The inverter circuit according to claim 1 wherein the load is at least one of a CFL and a HID.

8. The circuit according to claim 1 wherein the second capacitive network has the capacitive value larger than the capacitive value of the first capacitive network, by an amount which places the second capacitive network into series with the first inductor, the second inductor and the load, when the load is operational.

9. A high frequency, high power factor inverter circuit for generating a current for a load, the inverter circuit comprising:

a first inductor connected to receive an input voltage;

a second inductor connected in series with the first inductor and to the load;

a first capacitive network connected at a first end to a first node located between the first inductor and the second inductor, and at a second end to the load;

a second capacitive network connected at a first end to a circuit bus, at a second end to a reference bus, and at a second node to the load;

a leading current generated at the first rode by the first capacitive network when the load is activated;

a lagging current generated at the first node by the second inductor when the load is activated; and a summation current formed by the combination of the leading and lagging currents at the first node.

10. The circuit according to claim 9 further including a cathode heater winding magnetically coupled to the first inductor.

11. The inverter circuit according to claim 10 wherein the load is a lamp having a first cathode and a second cathode, the first cathode connected at a first end to the first capacitive network, and at a second end to the second capacitive network; and the second cathode in operational connection with the cathode heater winding.

12. The inverter circuit according to claim 9 wherein the load is a gas discharge lamp.

13. The inverter circuit according to claim 9 wherein the load is at least one of a CFL and a HID.

14. The circuit according to claim 8 wherein the second capacitive network has the capacitive value larger than the capacitive value of the first capacitive network, by an amount which places the second capacitive network into series with the first inductor, the second inductor and the load, when the load is operational.

* * * * *